US008096351B2

(12) United States Patent
Peterson et al.

(10) Patent No.: US 8,096,351 B2
(45) Date of Patent: Jan. 17, 2012

(54) WATER SENSING ADAPTABLE IN-FLOW CONTROL DEVICE AND METHOD OF USE

(75) Inventors: Elmer R. Peterson, Porter, TX (US); Martin P. Coronado, Cypress, TX (US); Bennett M. Richard, Kingwood, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 225 days.

(21) Appl. No.: 11/875,669

(22) Filed: Oct. 19, 2007

(65) Prior Publication Data

US 2009/0101355 A1 Apr. 23, 2009

(51) Int. Cl.
*E21B 43/12* (2006.01)

(52) U.S. Cl. ..... 166/227; 166/386; 166/373

(58) Field of Classification Search ..... 166/179, 166/227, 321, 386, 320, 373
See application file for complete search history.

(56) References Cited

U.S. PATENT DOCUMENTS

| | | | | |
|---|---|---|---|---|
| 1,362,552 | A | | 12/1920 | Alexander et al. |
| 1,649,524 | A | | 11/1927 | Hammond |
| 1,915,867 | A | | 6/1933 | Penick |
| 1,984,741 | A | | 12/1934 | Harrington |
| 2,089,477 | A | | 8/1937 | Halbert |
| 2,119,563 | A | | 6/1938 | Wells |
| 2,214,064 | A | | 9/1940 | Niles |
| 2,257,523 | A | | 9/1941 | Combs |
| 2,412,841 | A | | 12/1946 | Spangler |
| 2,762,437 | A | | 9/1956 | Egan et al. |
| 2,810,352 | A | | 10/1957 | Tumilson |
| 2,814,947 | A | * | 12/1957 | Stegemeier et al. ..... 73/152.18 |
| 2,942,668 | A | | 6/1960 | Maly et al. |

(Continued)

FOREIGN PATENT DOCUMENTS

CN 1385594 12/2002

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Kenneth L Thompson
(74) *Attorney, Agent, or Firm* — Mossman Kumar & Tyler PC

(57) ABSTRACT

A device and system for controlling fluid flow into a wellbore tubular may include a flow path in a production control device and at least one in-flow control element along the flow path. A media in the in-flow control element adjusts a cross-sectional flow area of the flow path by interacting with water. The media may be an inorganic solid, a water swellable polymer, or ion exchange resin beads. A method for controlling a fluid flow into a wellbore tubular may include conveying the fluid via a flow path from the formation into a flow bore of the wellbore; and adjusting a cross-sectional flow area of at least a portion of the flow path using a media that interacts with water. The method may include calibrating the media to permit a predetermined amount of flow across the media after interacts with water.

20 Claims, 5 Drawing Sheets

U.S. PATENT DOCUMENTS 2,945,541 A 7/1960 Maly et al.
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
4,153,757 A 5/1979 Clark
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A * 12/1996 Bridges et al. ..... 392/312
5,597,042 A 1/1997 Tubel et al.
5,609,204 A 3/1997 Rebardi et al.
5,673,751 A 10/1997 Head et al.
5,803,179 A 9/1998 Echols
5,829,522 A 11/1998 Ross et al.
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 Den Boer
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnerson et al.
6,581,681 B1 6/2003 Zimmerman et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 * 12/2005 Henriksen et al. ..... 166/386
7,011,076 B1 3/2006 Weldon et al.
7,084,094 B2 8/2006 Gunn et al.
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
7,469,743 B2 12/2008 Richards
7,673,678 B2 * 3/2010 MacDougall et al. ..... 166/228
2002/0020527 A1 * 2/2002 Kilaas et al. ..... 166/250.01
2002/0125009 A1 9/2002 Wetzel et al.
2003/0221834 A1 12/2003 Hess et al.
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 * 8/2005 Broyles et al. ..... 210/109
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado et al.
2006/0086498 A1 4/2006 Wetzel et al.
2006/0108114 A1 5/2006 Johnson
2006/0175065 A1 8/2006 Ross
2006/0185849 A1 8/2006 Edwards et al.
2006/0272814 A1 12/2006 Broome et al.
2006/0273876 A1 12/2006 Pachla
2007/0012444 A1 1/2007 Horgan et al.
2007/0039741 A1 2/2007 Hailey, Jr.
2007/0044962 A1 3/2007 Tibbles
2007/0131434 A1 6/2007 MacDougall et al.
2007/0246210 A1 10/2007 Richards
2007/0246213 A1 10/2007 Hailey, Jr.
2007/0246225 A1 10/2007 Hailey, Jr. et al.
2007/0246407 A1 10/2007 Richards et al.
2007/0272408 A1 11/2007 Zazovsky et al.
2008/0035349 A1 2/2008 Richard
2008/0035350 A1 2/2008 Henriksen et al.
2008/0053662 A1 3/2008 Williamson et al.
2008/0134590 A1 6/2008 Marr
2008/0135249 A1 6/2008 Fripp et al.
2008/0149323 A1 6/2008 O'Malley et al.
2008/0149351 A1 6/2008 Mayray et al.
2008/0236839 A1 10/2008 Oddie
2008/0236843 A1 10/2008 Scott et al.
2008/0283238 A1 11/2008 Richards et al.
2008/0296023 A1 12/2008 Willauer
2008/0314590 A1 12/2008 Patel
2009/0056816 A1 3/2009 Arov et al.
2009/0133869 A1 5/2009 Clem
2009/0133874 A1 5/2009 Dale et al.

| | | | |
|---|---|---|---|
| 2009/0139727 | A1 | 6/2009 | Tanju et al. |
| 2009/0205832 | A1 | 8/2009 | Jean-Luc |
| 2009/0205834 | A1 | 8/2009 | Garcia et al. |

FOREIGN PATENT DOCUMENTS

| | | | | |
|---|---|---|---|---|
| GB | 1492345 | | | 11/1977 |
| GB | 2421527 | A | * | 6/2006 |
| GB | 2341405 | | | 12/2007 |
| JP | 59089383 | B2 | | 5/1984 |
| SU | 1335677 | A | | 9/1987 |
| WO | 9403743 | A1 | | 2/1994 |
| WO | WO 00/79097 | | | 5/2000 |
| WO | WO 01/65063 | | | 2/2001 |
| WO | WO 01/77485 | | | 3/2001 |
| WO | WO 02/075110 | | | 9/2002 |
| WO | 2004018833 | A1 | | 3/2004 |
| WO | WO 2006/015277 | | | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Dirken, Ben J.; SPE, Koninklijke/Shell E&P Laboratorium; Pressure Drop in Horizontal Wells and Its Effect on Production Performance; pp. 1426-1433; Copyright 1990, Society of Petroleum Engineers.

Restarick, Henry, Halliburton Energy Services; Horizontal Completion Options in Reservoirs With Sand Problems—SPE 29831; SPE Middle East Oil Show, Mar. 11-14, 1995, Bahrain; pp. 545-560; Copyright 1995, Society of Petroleum Engineers, Inc.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer", Xue, W., Champ, S. amd Huglin, M. B. 2001, European Polymer Journal, 37(5) 869-875.

Dinarvand, R., D'Emanuele, A (1995) The use of thermoresponsive hydrogels for on-off release of molecules, J. Control. Rel. 36: 221-227.

Tanaka, T., Nishio, I., Sun, S.T., Ueno-Nisho, S. (1982) Collapse of gels in an electric field, Science. 216:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules. 17: 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003: Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, LA., Feb. 7-8, 1974; Copyright 1974. American Institute of Mining, Metallurgical and Petroleum Engineers, Inc.

* cited by examiner

WATER SENSING ADAPTABLE IN-FLOW CONTROL DEVICE AND METHOD OF USE

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it is desired to provide even drainage across a production zone and/or the ability to selectively close off or reduce in-flow within production zones experiencing an undesirable influx of water and/or gas.

The present disclosure addresses these and other needs of the prior art.

SUMMARY OF THE DISCLOSURE

In aspects, the present disclosure provides devices and related systems for controlling a flow of a fluid into a wellbore tubular in a wellbore. In one embodiment, a device may include a flow path associated with a production control device that conveys the fluid from the formation into a flow bore of the wellbore tubular. At least one in-flow control element along the flow path includes a media that adjusts a cross-sectional flow area of at least a portion of the flow path by interacting with water. The fluid may flow through the media and/or through an interspatial volume of the media. In one embodiment, the in-flow control element may include a chamber containing the media. In another embodiment, the at least one in-flow control element may include a channel having the media positioned on at least a portion of the surface area defining the channel. The channel may have a first cross-sectional flow area before the media interacts with water and a second cross-sectional flow area after the media interacts with water. In embodiments, the media may be configured to interact with a regeneration fluid. Also, in embodiments, the media may be an inorganic solid, including, but not limited to, silica vermiculite, mica, aluminosilicates, bentonite and mixtures thereof. In embodiments, the media may be a water swellable polymer that includes, but not limited to, a modified polystyrene. Also, the media may be ion exchange resin beads.

In aspects, the present disclosure provides a method for controlling a flow of a fluid into a wellbore tubular in a wellbore. The method may include conveying the fluid via a flow path from the formation into a flow bore of the wellbore; and adjusting a cross-sectional flow area of at least a portion of the flow path using a media that interacts with water. In embodiments, the method may include flowing the fluid through the media. The flowing may be through a first cross-sectional flow area before the media interacts with water and through a second cross-sectional flow area after the media interacts with water. In embodiments, the method may include calibrating the media to permit a predetermined amount of flow across the media after interacts with water.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
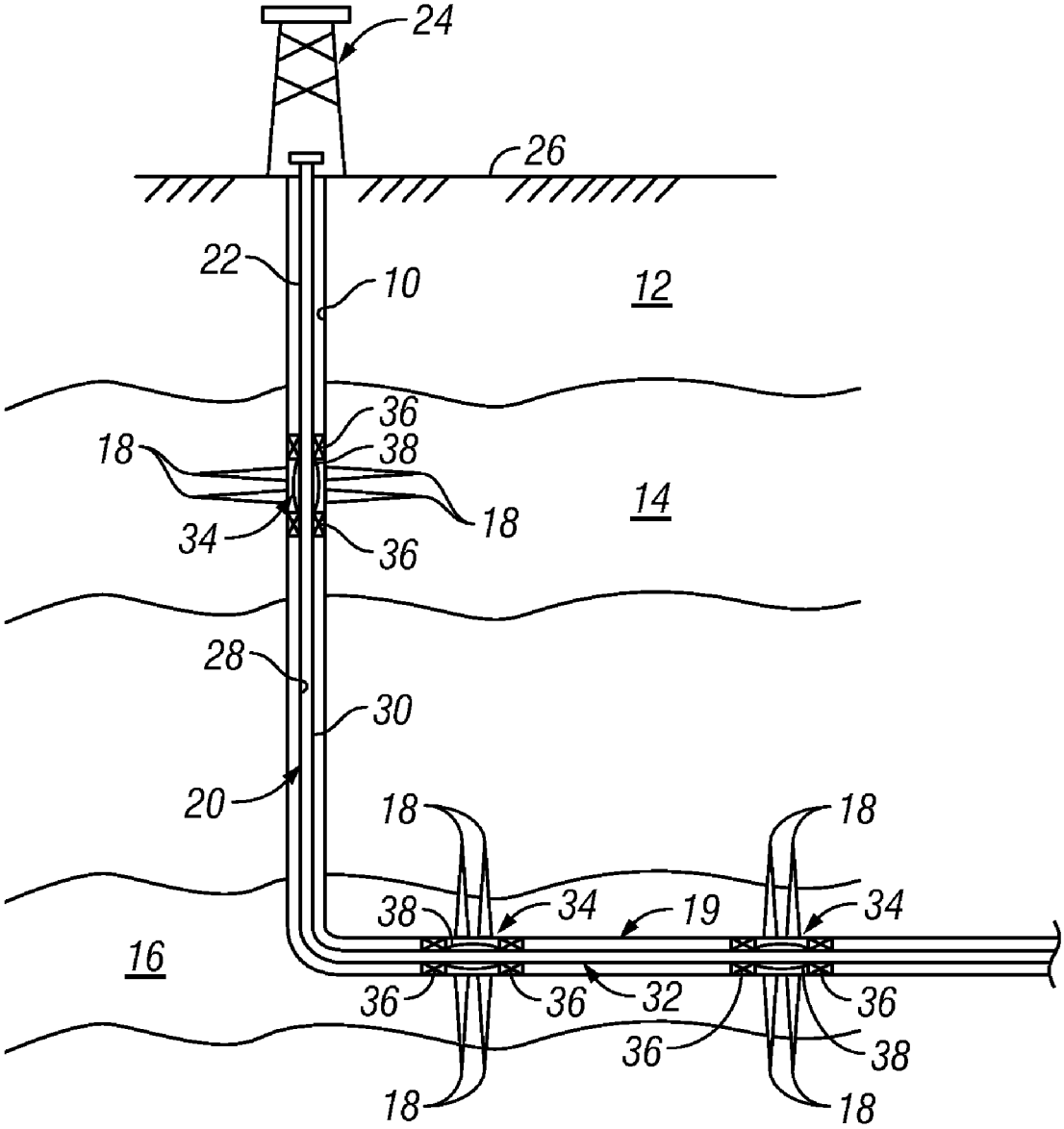
FIG. 1 is a schematic elevation view of an exemplary multi-zonal wellbore and production assembly which incorporates an in-flow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

In one embodiment of the disclosure, in-flow of water into the wellbore tubular of an oil well is controlled, at least in part using an in-flow control element that contains a media that can interact with water in fluids produced from an underground formation. The media interaction with water may be of any kind known to be useful in stopping or mitigating the flow of a fluid through a chamber filled with the media. These mechanisms include but are not limited to swelling, where the media swells in the presence of water thereby impeding the flow of water or water bearing fluids through the chamber.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
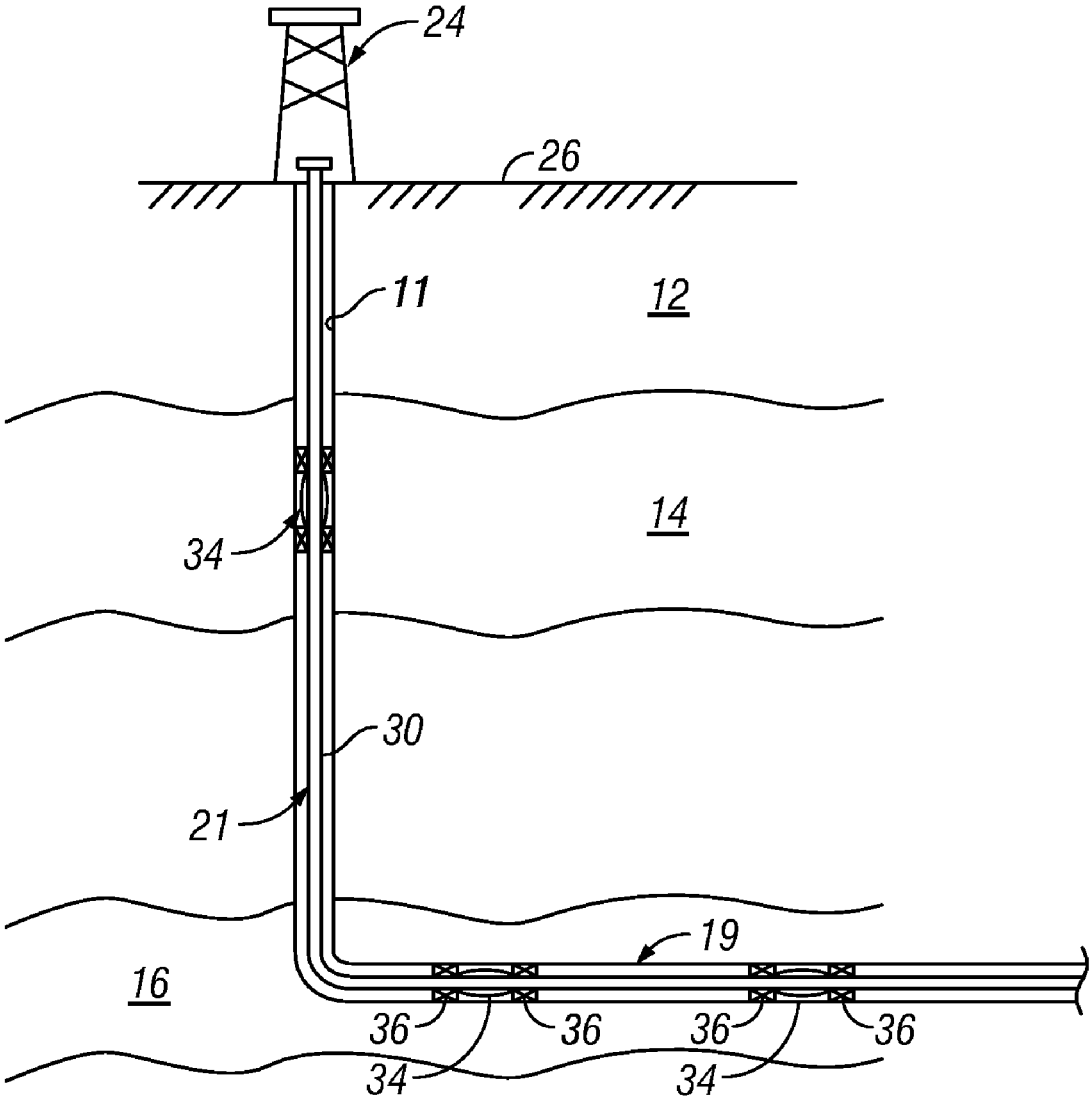
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
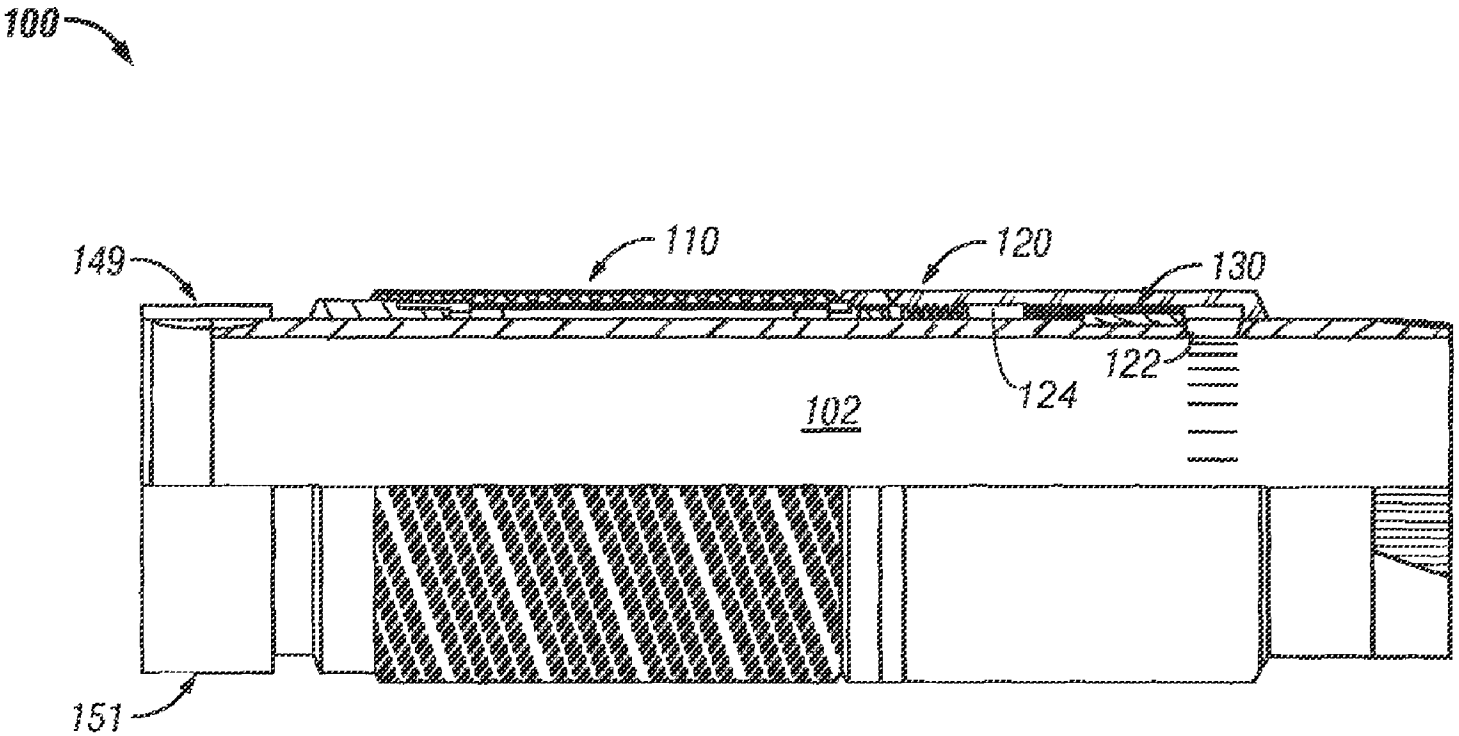
FIG. 3 is a schematic cross-sectional view of an exemplary in-flow control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting in-flow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids and an in-flow control device 120 that controls overall drainage rate from the formation. The in-flow control device 120 includes one or more flow paths between a formation and a wellbore tubular that may be configured to control one or more flow characteristics such as flow rates, pressure, etc. The particulate control device 110 can include known devices such as sand screens and associated gravel packs. In embodiments, the in-flow control device 120 utilizes one or more flow channels that control in-flow rate and/or the type of fluids entering the flow bore 102 via one or more flow bore orifices 122. In embodiments, the in-flow control device 120 may include one or more in-flow control element 130 that include a media 200 that interacts with one or more selected fluids in the in-flowing fluid to either partially or completely block the flow of fluid into the flow bore 102. In one aspect, the interaction of the media 200 with a fluid may be considered to be calibrated. By calibrate or calibrated, it is meant that one or more characteristics relating to the capacity of the media 200 to interact with water or another fluid is intentionally tuned or adjusted to occur in a predetermined manner or in response to a predetermined condition or set of conditions.

While the in-flow control element 130 and the media 200 are shown downstream of the particulate control device 110, it should be understood that the in-flow control element 130 and the media may be positioned anywhere along a flow path between the formation and the flow bore 102. For instance, the in-flow control element 130 may be integrated into the particulate control device 110 and/or any flow conduits such as channels 124 that may be used to generate a pressure drop across the production control device 100. Illustrative embodiments are described below.

Figure 4:
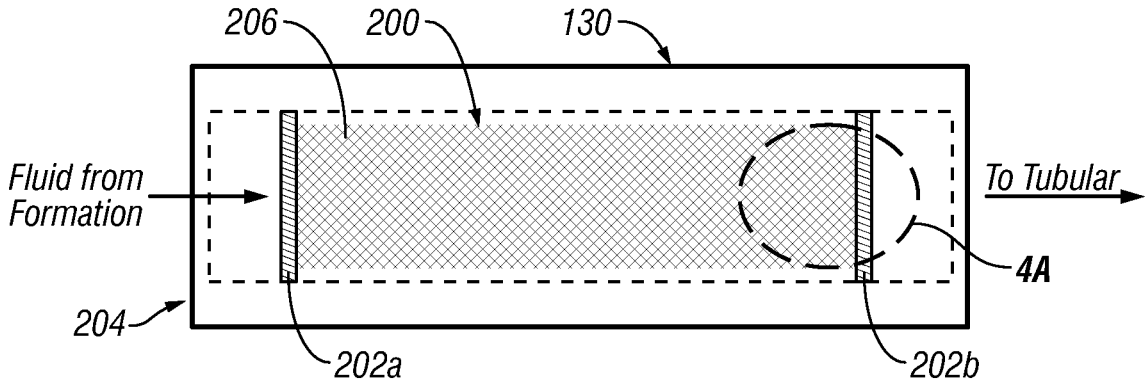
FIG. 4 is a schematic cross sectional view of a first exemplary embodiment of the in-flow control element of the disclosure.

Turning to FIG. 4, there is shown a first exemplary embodiment of an in-flow control element 130 of the disclosure that uses a media that interacts with a fluid to control fluid flow across the in-flow control device 120 (FIG. 3). The in-flow control element 130 includes a flow path 204. A first and a second screen 202 *a*&*b* in the flow path 204 define a chamber 206. A media 200 is located within the chamber 206. The media 200 may substantially completely fill the chamber 206 such that the fluid flowing along the flow path 204 passes through the media 200.

In this embodiment, as fluid from the formation passes through the media 200, no substantial change in pressure occurs as long as the formation fluid includes comparatively low amounts of water. If a water incursion into the formation fluid occurs, the media 200 interacts with the formation fluid to either partially or completely block the flow of the formation fluid.

Figure 4A:
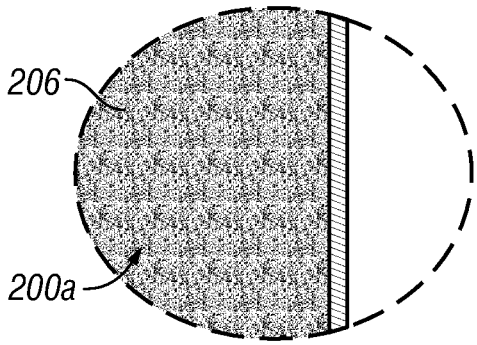
FIG. 4*a* is an excerpt from FIG. 4 showing the chamber of an embodiment of an in-flow control element filled with a particulate type media.

In FIG. 4*a*, an excerpt of FIG. 4 corresponding to the section of FIG. 4 within the dotted circle shows an alternative embodiment of the disclosure. In this embodiment, the media 200*a* is particulate, such as a packed body of ion exchange resin beads and the chamber 206 (FIG. 4) is a fixed volume space. The beads may be formed as balls having little or no permeability. When water flows through the chamber 206 (FIG. 4), the ion exchange resin increases in size by absorbing the water. Because the beads are relatively impermeable, the cross-sectional flow area is reduced by the swelling of the ion exchange resin. Thus, flow across the chamber 206 (FIG. 4) may be reduced or stopped.

Figure 5:
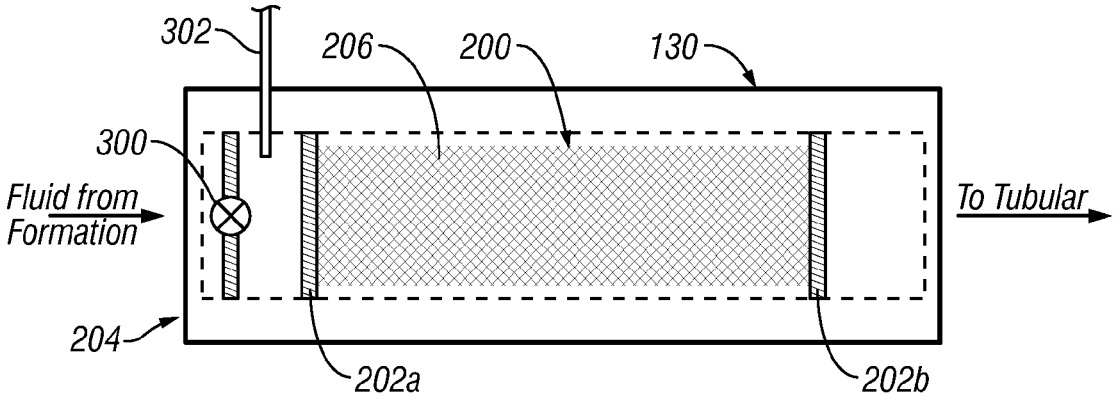
FIG. 5 is a schematic cross sectional view of a second exemplary embodiment of an in-flow control element of the disclosure.

FIG. 5 illustrates a second exemplary embodiment of an in-flow control element 130 of the disclosure. As in FIG. 4, the in-flow control element 130 includes a flow path 204, and within the flow path 204, screens 202*a*&*b* define a chamber 206 containing a media 200. In this embodiment there is also a valve 300 located between the chamber 206 containing the media 200 and entrance to the in-flow control element 130. As drawn, this is a check valve, but in other embodiment, the valve may be any kind of valve that is able to restrict fluid flow in at least one direction within the flow path 204. Also present is a feed line 302 which is used to feed a regenerating fluid into the space between the valve and the chamber 206.

In the exemplary embodiments shown in FIG. 4 and FIG. 5, screens 202*a*&*b* are used to define a chamber 206 that includes the media 200. If the media 200 is in the form of a pellet or powder, then a screen is logical selection since it would hold the pellets or powder in place and still allow the produced fluid to pass though the flow path 204 and through the media 200. The use of screens is not, however, a limitation on the invention. The media 200 may be retained in the chamber 206 using any method known to those of ordinary skill in the art to be useful. For example, when the media 200 is solid polymer, it may be led in place with a clamp or a retaining ring. Even when the media 200 is particulate other methods including membranes, filters, slit screens, porous packings and the like may be so used.

Figure 6A:
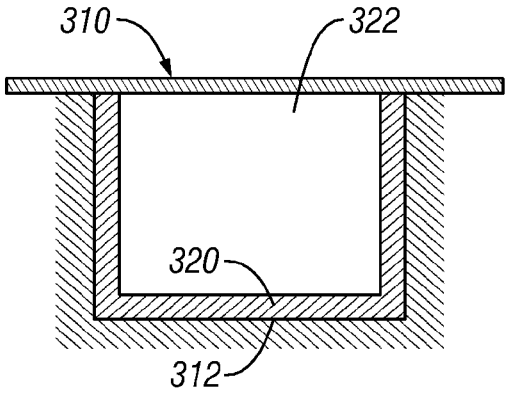
FIGS. 6A and 6B are schematic cross-sectional views of a third exemplary embodiment of an in-flow control element of the disclosure.
Figure 6B:
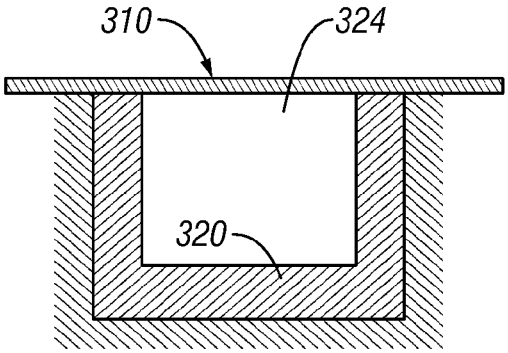

Referring now to FIGS. 6A and 6B, there is shown a flow path 310 that includes a material 320 that may expand or contract upon interacting with the fluid flowing in the flow path 310. For example, the flow path 310 may have a first cross-sectional flow area 322 for a fluid that is mostly oil and have a second smaller cross-sectional flow area 324 for a fluid that is mostly water. Thus, a greater pressure differential and lower flow rate may be imposed on the fluid that is mostly water. The flow path 310 may be within the particulate control device 110 (FIG. 3), along the channels 124 (FIG. 3), or elsewhere along the production control device 100 (FIG. 3). The material 320 may be any of those described previously or described below. In embodiments, the material 320 may be formed as a coating on a surface 312 of the flow path 310 or an insert positioned in the flow path 310. Other configurations known in the art may also be used to fix or deposit the material 320 into the flow path 310. Moreover, it should be understood that the rectangular cross-sectional flow path is merely illustrative and other shapes (e.g., circular). Also, the material 320 may be positioned on all or less than all of the surfaces areas defining the flow path 310. In other embodiments, the material 310 may be configured to completely seal off the flow path 310.

In an exemplary mode of operation, the material 320 provides a first cross-sectional area 322 in a non-interacting state and a second smaller cross-sectional area 324 when reacting with a fluid, such as water. Thus, in embodiments, the material 320 does not swell or expand to completely seal the flow path 310 against fluid flow. Rather, fluid may still flow through the flow path 310, but at a reduced flow rate. This may be advantageous where the formation is dynamic. For instance, at some point, the water may dissipate and the fluid may return to containing mostly oil. Maintaining a relatively small and controlled flow rate may allow the material 320 to reset from the swollen condition and form the larger cross-sectional area 322 for the oil flow.

In at least one embodiment of the disclosure, it may be desirable to regenerate the media 200 after it has interacted with water so that flow from the formation may be resumed. In such an embodiment, the valve 300 may, for example, block the flow fluid in the direction of the formation allowing a feed of a regenerating fluid to be fed at a comparatively high pressure through the media 200 in order to regenerate it.

One embodiment of the disclosure is a method for preventing or mitigating the flow of water into a wellbore tubular using an in-flow control element. In one embodiment of the disclosure, the in-flow control element can be used wherein the media is passive when the fluid being produced from the formation is comparatively high in hydrocarbons. As oil is produced from a formation, the concentration of water in the fluid being produced can increase to the point where it is not desirable to remover further fluid from the well. When the water in the fluid being produced reaches such a concentration, the media may interact with water in the fluid to decrease the flow rate of production fluid through the in-flow control element.

One mechanism by which the water may interact with the media useful with embodiments of the disclosure is swelling. Swelling, for the purposes of this disclosure means increasing in volume. If the in-flow control element has a limited volume, and the media swells to point that the produced fluid cannot pass through the media, then the flow is stopped, thus preventing or mitigating an influx of water into crude oil collection systems at the surface. Swelling can occur in both particulate and solid media. For example, one media that may be useful are water swellable polymers. Such polymers may be in the form of pellets or even solids molded to fit within an in-flow control element. Any water swellable polymer that stable in downhole conditions and known to those of ordinary skill in the art to be useful can be used in the method of the disclosure.

Exemplary polymers include crosslinked polyacrylate salts; saponified products of acrylic acid ester-vinyl acetate copolymers; modified products of crosslinked polyvinyl alcohol; crosslinked products of partially neutralized polyacrylate salts; crosslinked products of isobutylene-maleic anhydride copolymers; and starch-acrylic acid grafted polymers. Other such polymers include poly-N-vinyl-2-pyrrolidone; vinyl alkyl ether/maleic an hydride copolymers; vinyl alkyl ether/maleic acid copolymers; vinyl-2-pyrrolidone/vinyl alkyl ether copolymers wherein the alkyl moiety contains from 1 to 3 carbon atoms, the lower alkyl esters of said vinyl ether/maleic anhydride copolymers, and the cross-linked polymers and interpolymers of these. Modified polystyrene and polyolefins may be used wherein the polymer is modified to include functional groups that would cause the modified polymers to swell in the presence of water. For example, polystyrene modified with ionic functional groups such as sulfonic acid groups can be used with embodiments of the disclosure. One such modified polystyrene is known as ion exchange resin Naturally occurring polymers or polymer derived from naturally occurring materials that may be useful include gum Arabic, tragacanth gum, arabinogalactan, locust bean gum (carob gum), guar gum, karaya gum, carrageenan, pectin, agar-agar, quince seed (i.e., marmelo), starch from rice, corn, potato or wheat, algae colloid, and trant gum; bacteria-derived polymers such as xanthan gum, dextran, succinoglucan, and pullulan; animal-derived polymers such as collagen, casein, albumin, and gelatin; starch-derived polymers such as carboxymethyl starch and methylhydroxypropyl starch; cellulose polymers such as methyl cellulose, ethyl cellulose, methylhydroxypropyl cellulose, carboxymethyl cellulose, hydroxymethyl cellulose, hydroxypropyl cellulose, nitrocellulose, sodium cellulose sulfate, sodium carboxymethyl cellulose, crystalline cellulose, and cellulose powder; alginic acid-derived polymers such as sodium alginate and propylene glycol alginate; vinyl polymers such as polyvinyl methylether, polyvinylpyrrolidone. In one embodiment of the disclosure, the media is ion exchange resin beads.

The swellable media may also include inorganic compounds. Silica may be prepared into silica gels that swell in the presence of water. Vermiculite and mica and certain clays such as aluminosilicates and bentonite can also be formed into water swellable pellets and powders.

Another group of materials that may be useful as a media includes those that, in the presence of water pack more compactly than in the presence of a hydrocarbon. One such material is finely ground inert material that has a highly polar coating. When packed into an in-flow control element. Any such material that is stable under downhole conditions may be used with the embodiments of the disclosure.

If an oil well includes a apparatus of the disclosure, and it is desirable that the well be decommissioned upon a water incursion, such as when an reservoir is undergoing water flooding secondary recovery, then the in-flow control device may be used downhole without any communication with the surface. If, on the other hand, the device is intended for long term use where even comparatively dry crude oil will eventually cause the media to reduce the flow of produced fluids or where it will be desirable to restart the flow of produced fluids after such flow has been stopped, it may be desirable to regenerate or replace the media within the in-flow control element.

The media may be regenerated by any method known to be useful to those of ordinary skill in the art to do so. One method useful for regenerating the media may be to expose the media to a flow of a regenerating fluid. In one such embodiment, the fluid may be pumped down the tubular from the surface at a pressure sufficient to force the regenerating fluid through the media. In an alternative embodiment where it is not desirable to force regeneration fluid into the formation, an apparatus such as that in FIG. 5. may be used. In such an embodiment, a regeneration fluid is forced down hole through the feed tube 302 and into the space between the valve 300 and chamber 206. If the valve is a check valve, then the regenerating fluid my be simple pumped into this space at a pressure sufficient to force the fluid through the media and into the tubular since the check valve will prevent back flow into the formation. If the valve is not a check valve then it may need to be closed prior to starting the regeneration fluid flow.

Regenerating fluids may have at least two properties. The first is that the regenerating fluid should have a greater affinity for water than the media. The second is that the regenerating fluid should cause little or no degradation of the media. Just as there are may compounds that may be used as the media of the disclosure, there may also be many liquids that can function as the regenerating fluid. For example, if the media is an inorganic powder or pellet, then methanol, ethanol, propanol, isopropanol, acetone, methyl ethyl ketone, and the like may be used as a regenerating fluid is some oil wells. If the media is a polymer that is sensitive to such materials or if a higher boiling point regenerating fluid is need, then some of the commercial poly ether alcohols, for example may be used. One of ordinary skill in the art of operating an oil well will understand how to select a regenerating fluid that is effective at downhole conditions and compatible with the media to be treated.

Referring now to FIGS. 6A and 6B, in other variants, the material 320 in the flow path 310 may be configured to operate according to HPLC (high performance liquid chromatography). The material 320 may include one or more chemicals that may separate the constituent components of a flowing fluid (e.g., oil and water) based on factors such as dipole-dipole interactions, ionic interactions or molecule sizes. For example, as is known, an oil molecule is size-wise larger than a water molecule. Thus, the material 320 may be configured to be penetrable by water but relatively impenetrable by oil. Such a material then would retain water. In another example, ion-exchange chromatography techniques may be used to configure the material 320 to separate the fluid based on the charge properties of the molecules. The attraction or repulsion of the molecules by the material may be used to selectively control the flow of the components (e.g., oil or water) in a fluid.

Inflow control elements of the disclosure may be particularly useful in an oil field undergoing secondary recovery such as water flooding. Once water break through from the flooding occurs, the in-flow control device may, in effect, block the flow of fluids permanently thus preventing an incursion of large amounts of water into the crude oil being recovered. The in-flow control device, or perhaps only the in-flow control element may be removed if the operator of the well deems it advisable to continue using the well. For example, such a well may be useful for continuing the water flooding of the formation.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other wellbore tubulars.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid into a wellbore tubular in a wellbore, comprising:

a flow path associated with a production control device, the flow path configured to convey the fluid from the formation into a flow bore of the wellbore tubular;

a particulate control device positioned along the flow path; and at least one in-flow control element along the flow path and downstream of the particulate control device, the in-flow control element including a particulated media that reduces a flow rate in at least a portion of the flow path by interacting with water, wherein the particulated media separates the fluid based on molecular charge and is configured to maintain a flow of the fluid across the media and not completely seal the flow path after interacting with water.

2. The apparatus of claim 1 wherein the media is configured to increase flow across the in-flow control element as water in the fluid dissipates.

3. The apparatus of claim 1 wherein the particulated media is packed and wherein the fluid flows through an interspatial volume of the particulated media.

4. The apparatus of claim 1 wherein the media is configured to interact with a regeneration fluid.

5. The apparatus of claim 1 wherein the media includes is an inorganic solid.

6. The apparatus of claim 1 wherein the media is ion exchange resin beads.

7. A method for controlling a flow of a fluid into a wellbore tubular in a wellbore, comprising:

conveying the fluid via a flow path from a particulate control device into a flow bore of the wellbore; and adjusting a cross-sectional flow area of at least a portion of the flow path using a particulated media that interacts with water and separates the fluid based on molecular charge while maintaining a flow of the fluid across the media without completely sealing the flow path.

8. The method of claim 7 further comprising increasing flow along the flow path as water in the fluid dissipates.

9. The method of claim 7 wherein the media includes an inorganic solid.

10. A system for controlling a flow of a fluid in a well, comprising:

a wellbore tubular in the well;

a production control device positioned along the wellbore tubular;

a particulate control device associated with the production control device;

a flow path associated with the production control device, the flow path configured to convey the fluid from the particulate control device into a flow bore of the wellbore tubular; and at least one in-flow control element along the flow path, the in-flow control element including a media that adjusts flow along at least a portion of the flow path by interacting with water, wherein the media interacts with molecules of a component of the fluid by attraction, and wherein the media is fixed to a surface of the flow path and configured to maintain a flow of the fluid along the flow path and not completely seal the flow path after interacting with water.

11. The system of claim 10 wherein the media is one of: (i) a coating on the surface, and (ii) an insert positioned on the surface.

12. The system of claim 10 wherein the media is configured to increase flow across the in-flow control element as water in the fluid dissipates.

13. An apparatus for controlling a flow of a fluid into a wellbore tubular in a wellbore, comprising:

a flow path associated with a production control device, the flow path configured to convey the fluid from the formation into a flow bore of the wellbore tubular;

a particulate control device positioned along the flow path; and at least one in-flow control element along the flow path and downstream of the particulate control device, the in-flow control element including a particulated media that reduces a flow rate in at least a portion of the flow path by interacting with water, wherein the particulated media separates the fluid based on molecular size and is configured to maintain a flow of the fluid across the media and not completely seal the flow path after interacting with water.

14. The apparatus of claim 13 wherein the media is configured to increase flow across the in-flow control element as water in the fluid dissipates.

15. The apparatus of claim 13 wherein the particulated media is packed and wherein the fluid flows through an interspatial volume of the particulated media.

16. An apparatus for controlling a flow of a fluid into a wellbore tubular in a wellbore, comprising:

a flow path associated with a production control device, the flow path configured to convey the fluid from the formation into a flow bore of the wellbore tubular;

a particulate control device positioned along the flow path; and at least one in-flow control element along the flow path and downstream of the particulate control device, the in-flow control element including a particulated media that reduces a flow rate in at least a portion of the flow path by interacting with water, wherein the particulated media includes a polar coating and is configured to maintain a flow of the fluid across the media and not completely seal the flow path after interacting with water.

17. The apparatus of claim 16 wherein the media is configured to increase flow across the in-flow control element as water in the fluid dissipates.

18. The apparatus of claim 16 wherein the particulated media is packed and wherein the fluid flows through an interspatial volume of the particulated media.

19. A system for controlling a flow of a fluid in a well, comprising:

a wellbore tubular in the well;

a production control device positioned along the wellbore tubular;

a particulate control device associated with the production control device;

a flow path associated with the production control device, the flow path configured to convey the fluid from the particulate control device into a flow bore of the wellbore tubular; and at least one in-flow control element along the flow path, the in-flow control element including a media that adjusts flow along at least a portion of the flow path by interacting with water, wherein the media interacts with molecules of a component of the fluid by repulsion, and wherein the media is fixed to a surface of the flow path and configured to maintain a flow of the fluid along the flow path and not completely seal the flow path after interacting with water.

20. The system of claim 19 wherein the media is configured to increase flow across the in-flow control element as water in the fluid dissipates.

* * * * *